US011644024B2

(12) United States Patent
Takahashi

(10) Patent No.: US 11,644,024 B2
(45) Date of Patent: May 9, 2023

(54) CRYOPUMP

(71) Applicant: SUMITOMO HEAVY INDUSTRIES, LTD., Tokyo (JP)

(72) Inventor: Kakeru Takahashi, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 774 days.

(21) Appl. No.: 16/533,097

(22) Filed: Aug. 6, 2019

(65) Prior Publication Data

US 2019/0360477 A1 Nov. 28, 2019

Related U.S. Application Data

(63) Continuation of application No. PCT/JP2018/003572, filed on Feb. 2, 2018.

(30) Foreign Application Priority Data

Feb. 7, 2017 (JP) ..... JP2017-020601

(51) Int. Cl.

| | |
|---|---|
| ***F04B 37/02*** | (2006.01) |
| ***F04B 39/06*** | (2006.01) |
| ***F25D 19/00*** | (2006.01) |
| ***F04B 37/08*** | (2006.01) |

(52) U.S. Cl.

CPC ..... *F04B 37/08* (2013.01); *F04B 37/02* (2013.01); *F04B 39/06* (2013.01); *F25D 19/006* (2013.01)

(58) Field of Classification Search

CPC ..... F04B 37/08; F04B 37/02; F04B 39/06; F04B 37/085; F04B 37/16; F25D 19/006; F25D 19/00; F05B 2210/12; B01D 8/00

See application file for complete search history.

(56) References Cited

U.S. PATENT DOCUMENTS

| | | | | |
|---|---|---|---|---|
| 4,506,513 | A * | 3/1985 | Max | B01D 8/00 62/278 |
| 4,577,465 | A * | 3/1986 | Olsen | F04B 37/08 62/100 |
| 4,763,483 | A * | 8/1988 | Olsen | F04B 37/08 62/383 |
| 8,572,988 | B2 | 11/2013 | Tanaka | |

(Continued)

FOREIGN PATENT DOCUMENTS

| | | |
|---|---|---|
| JP | S61-019987 A | 1/1986 |
| JP | H03-151577 A | 6/1991 |

(Continued)

*Primary Examiner* — Miguel A Diaz
*Assistant Examiner* — Ibrahim A. Michael Adeniji
(74) *Attorney, Agent, or Firm* — Michael Best & Friedrich LLP

(57) ABSTRACT

A cryopump includes a cryocooler which includes a high-temperature cooling stage and a low-temperature cooling stage, a radiation shield which is thermally coupled to the high-temperature cooling stage and axially extends in a tubular shape from a cryopump intake port, and a low-temperature cryopanel section which is thermally coupled to the low-temperature cooling stage, is surrounded by the radiation shield, and includes a plurality of cryopanels and a plurality of heat transfer bodies axially arranged in columnar shape, and in which the plurality of cryopanels and the plurality of heat transfer bodies are axially stacked.

16 Claims, 5 Drawing Sheets

(56) References Cited

U.S. PATENT DOCUMENTS

| | | | | |
|---|---|---|---|---|
| 2010/0000235 | A1* | 1/2010 | Tanaka | F04B 37/08 62/55.5 |
| 2014/0345300 | A1* | 11/2014 | Takahashi | F04B 37/08 62/55.5 |

FOREIGN PATENT DOCUMENTS

| | | | |
|---|---|---|---|
| JP | 2009-062891 | A | 3/2009 |
| JP | 2011-167647 | A | 9/2011 |
| JP | 2012-237262 | A | 12/2012 |
| JP | 2014-227989 | A | 12/2014 |

* cited by examiner

CRYOPUMP

RELATED APPLICATIONS

The contents of Japanese Patent Application No. 2017-020601, and of International Patent Application No. PCT/JP2018/003572, on the basis of each of which priority benefits are claimed in an accompanying application data sheet, are in their entirety incorporated herein by reference.

BACKGROUND

Technical Field

Certain embodiment of the present invention relates to a cryopump.

Description of Related Art

A cryopump is a vacuum pump which condenses and adsorbs gas molecules on a cryopanel cooled to a cryogenic temperature to capture and exhaust the gas molecules. In general, the cryopump is used to realize a clean vacuum environment which is required in a semiconductor circuit manufacturing process or the like. For example, in one of applications of the cryopump like an ion implantation process, most of gases to be exhausted may be a non-condensable gas such as hydrogen. The non-condensable gas can be exhausted by being adsorbed to an adsorption region cooled to a cryogenic temperature.

SUMMARY

According to an embodiment of the present invention, there is provided a cryopump including: a cryocooler which includes a high-temperature cooling stage and a low-temperature cooling stage; a radiation shield which is thermally coupled to the high-temperature cooling stage and axially extends in a tubular shape from a cryopump intake port; and a low-temperature cryopanel section which is thermally coupled to the low-temperature cooling stage, is surrounded by the radiation shield, and includes a plurality of cryopanels and a plurality of heat transfer bodies axially arranged in columnar shape, and in which the plurality of cryopanels and the plurality of heat transfer bodies are axially stacked.

DETAILED DESCRIPTION

Figure 1:
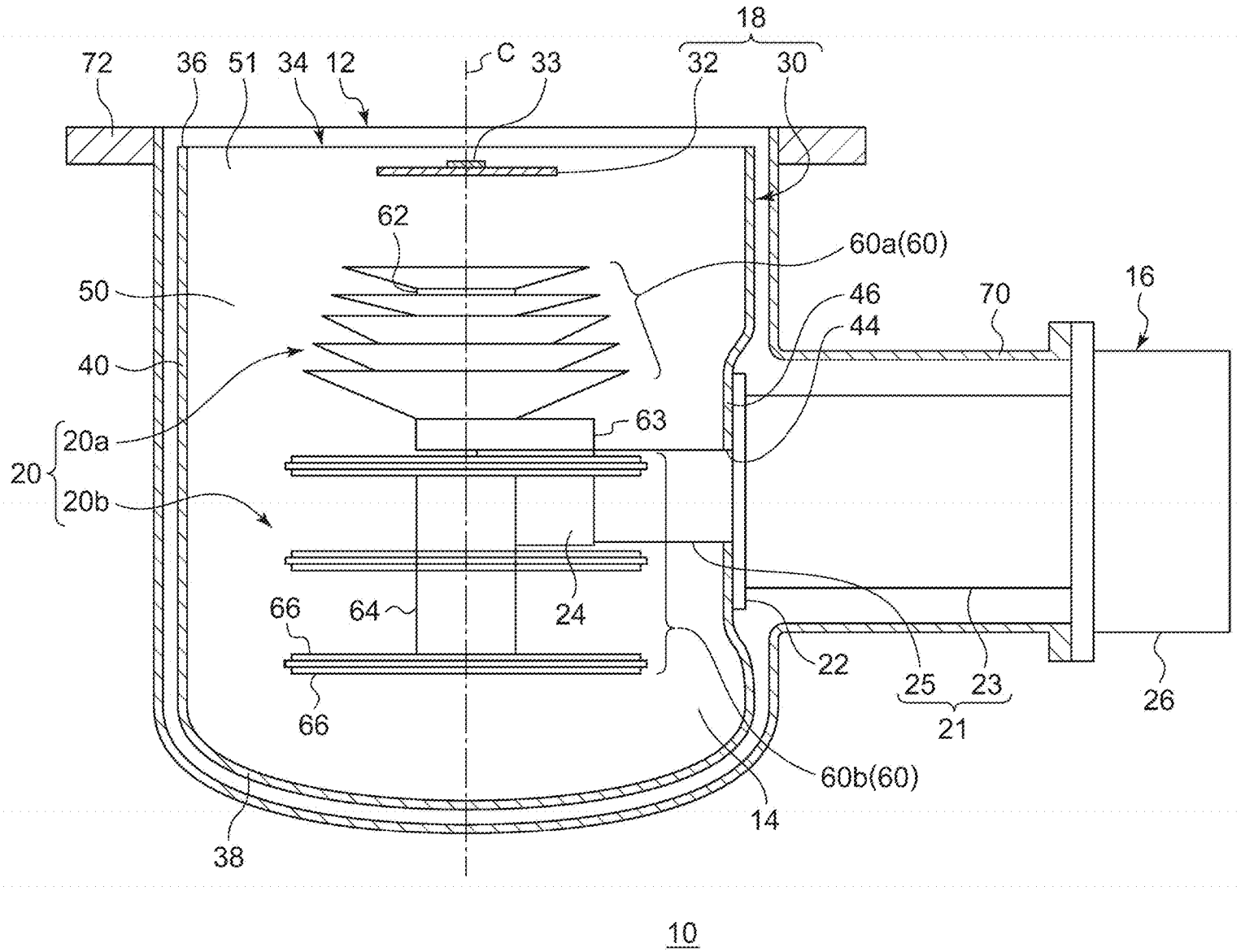
FIG. 1 is a view schematically showing a cryopump according to an embodiment.

It is desirable to improve exhaust performance of a cryopump.

In addition, arbitrary combinations of the above-described components, or components or expression of the present invention may be replaced by each other in methods, devices, systems, or the like, and these replacements are also included in aspects of the present invention.

According to the present invention, it is possible to improve exhaust performance of a cryopump.

Hereinafter, an embodiment of the present invention will be described in detail with reference to the drawings. In descriptions and drawings, the same or equivalent components, members, and processes are denoted by the same reference numerals, and repeated descriptions thereof will be appropriately omitted. Scales and shapes of shown parts are set conveniently for ease of explanation, and are not to be interpreted as being limited unless otherwise noted. The embodiment is illustrative and do not limit the scope of the present invention. All features or combinations thereof described in the embodiment are not necessarily essential to the invention.

In general, a cryopump includes a high-temperature cryopanel section which is cooled by a high-temperature cooling stage of a cryocooler and a low-temperature cryopanel section which is cooled by a low-temperature cooling stage of the cryocooler. The high-temperature cryopanel section is provided to protect the low-temperature cryopanel section from radiant heat. The low-temperature cryopanel section includes a plurality of cryopanels, and the plurality of cryopanels are attached to the low-temperature cooling stage via an attachment structure.

As a result of intensive studies on a cryopump, the present inventors have come to recognize the following problems. In most cryopumps, the high-temperature cryopanel section and the low-temperature cryopanel section are designed based on the axisymmetric shapes such as a disk, a cylinder, and a cone. Nevertheless, the cryopanel attachment structure is based on non-axisymmetric shapes such as rectangles and cuboids. This cause limitation on simplification and miniaturization of the attachment structure. If the attachment structure has a complicated shape and a size thereof increases, a space for disposing the cryopanel will be cut accordingly. As a result, the cryopanel area is reduced and exhaust performance (for example, storage capacity of non-condensable gas, exhaust speed) of the cryopump decreases. Therefore, there is a room for improvement in a design of the existing cryopanel attachment structure in order to improve the exhaust performance.

Figure 2:
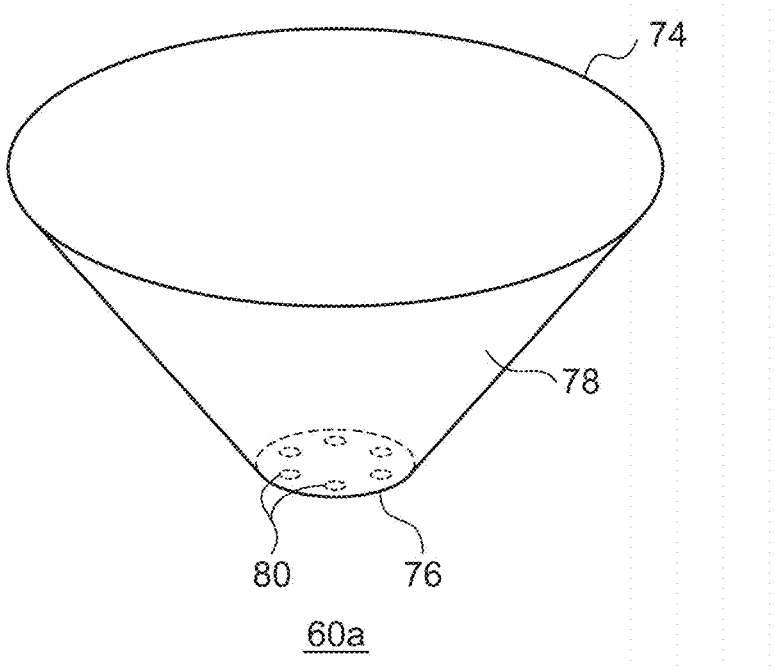
FIG. 2 is a perspective view schematically showing an upper cryopanel of a second stage cryopanel assembly according to the embodiment.
Figure 3:
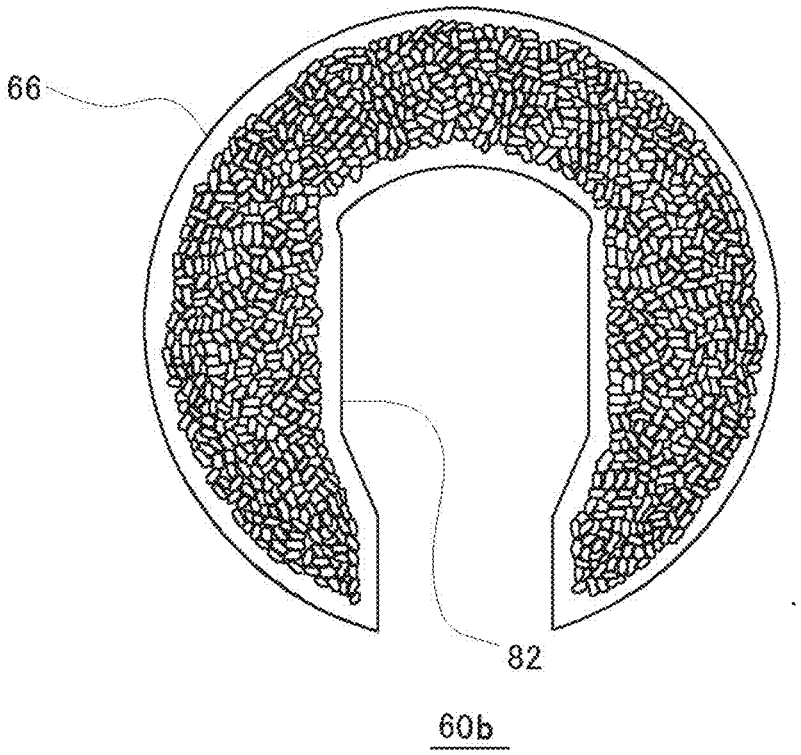
FIG. 3 is a top view schematically showing a lower cryopanel of the second stage cryopanel assembly according to the embodiment.

FIG. 1 schematically shows a cryopump 10 according to an embodiment. FIG. 2 is a perspective view schematically showing an upper cryopanel of a second stage cryopanel assembly according to the embodiment. FIG. 3 is a top view schematically showing a lower cryopanel of the second stage cryopanel assembly according to the embodiment.

For example, the cryopump 10 is attached to a vacuum chamber of an ion implanter, a sputtering apparatus, vapor deposition apparatus, or other vacuum processing apparatus, and is used to increase a degree of vacuum inside the vacuum chamber to the level required for a desired vacuum process. The cryopump 10 has a cryopump intake port (hereinafter, simply referred to as an "intake port") 12 for receiving a gas to be exhausted from the vacuum chamber. The gas enters an internal space 14 of the cryopump 10 through the intake port 12.

In addition, hereinafter, terms such as an "axial direction" and a "radial direction" are used to easily indicate positional relationships of components of the cryopump 10. The axial direction of the cryopump 10 indicates a direction (a direction along a center axis C in the drawings) passing through the intake port 12, and the radial direction indicates a direction (a direction perpendicular to the center axis C) along the intake port 12. For convenience, a side relatively close to the intake port 12 in the axial direction may be referred to as an "upper side", and a side relatively far from the intake port 12 may be referred to as a "lower side". That is, a side relatively far from a bottom section of the cryopump 10 may be referred to as the "upper side", and a side relatively close to the bottom section may be referred to as the "lower side". A side close to a center (the center axis C in the drawings) of the intake port 12 in the radial direction may be referred to as an "inner side", and a side close to a peripheral edge of the intake port 12 may be referred to as an "outer side". In addition, the above-described expressions are not related to the disposition of the cryopump 10 when the cryopump 10 is attached to the vacuum chamber. For example, the cryopump 10 may be attached to the vacuum chamber in a state where the intake port 12 is positioned downward in a vertical direction.

In addition, a direction surrounding the axial direction may be referred to a "circumferential direction". The circumferential direction is a second direction along the intake port 12 and is a tangential direction orthogonal to the radial direction.

The cryopump 10 includes a cryocooler 16, a first stage cryopanel 18, a second stage cryopanel assembly 20, and a cryopump housing 70. The first stage cryopanel 18 may be referred to as a high-temperature cryopanel section or a 100K section. The second stage cryopanel assembly 20 may be referred to as a low-temperature cryopanel section or a 10K section.

For example, the cryocooler 16 is a cryocooler such as a Gifford McMahon type cryocooler (so-called GM cryocooler). The cryocooler 16 is a two-stage cryocooler. Accordingly, the cryocooler 16 includes a first cooling stage 22 and a second cooling stage 24. The cryocooler 16 is configured so as to cool the first cooling stage 22 to a first cooling temperature and cool the second cooling stage 24 to a second cooling temperature. The second cooling temperature is lower than the first cooling temperature. For example, the first cooling stage 22 is cooled to approximately 65K to 120K, preferably, 80K to 100K, and the second cooling stage 24 is cooled to approximately 10K to 20K.

In addition, the cryocooler 16 includes a cryocooler structural section 21 which structurally supports the second cooling stage 24 to the first cooling stage 22 and structurally supports the first cooling stage 22 to a room-temperature section 26 of the cryocooler 16. Accordingly, the cryocooler structural section 21 includes a first cylinder 23 and a second cylinder 25 which coaxially extend in the radial direction. The first cylinder 23 connects the room-temperature section 26 of the cryocooler 16 to the first cooling stage 22. The second cylinder 25 connects the first cooling stage 22 to the second cooling stage 24. The room-temperature section 26, the first cylinder 23, the first cooling stage 22, the second cylinder 25, and the second cooling stage 24 are linearly arranged in this order.

A first displacer (not shown) and a second displacer (not shown) are respectively disposed inside the first cylinder 23 and the second cylinder 25 so as to be reciprocated. A first regenerator and a second regenerator (not shown) are respectively incorporated into the first displacer and the second displacer. Moreover, the room-temperature section 26 includes a drive mechanism (not shown) for reciprocating the first displacer and the second displacer. The drive mechanism includes a flow path switching mechanism which switches a flow path of a working gas (for example, helium) such that the working gas is repeatedly supplied to or discharged from the inside of the cryocooler 16 periodically.

The cryocooler 16 is connected to a compressor (not shown) of the working gas. The cryocooler 16 expands the working gas compressed by the compressor inside the cryocooler 16 to cool the first cooling stage 22 and the second cooling stage 24. The expanded working gas is recovered to the compressor so as to be compressed again. The cryocooler 16 repeats a thermal cycle which includes supplying and discharging of the working gas and reciprocations of the first displacer and the second displacer synchronized with the supplying and the discharging, and generates chill.

The shown cryopump 10 is a so-called horizontal cryopump. In general, the horizontal cryopump is a cryopump in which the cryocooler 16 is disposed to intersect (generally, to be orthogonal to) the center axis C of the cryopump 10.

The first stage cryopanel 18 includes a radiation shield 30 and an inlet cryopanel 32, and encloses the second stage cryopanel assembly 20. The first stage cryopanel 18 provides a cryogenic surface to protect the second stage cryopanel assembly 20 from radiant heat from the outside of the cryopump 10 or the cryopump housing 70. The first stage cryopanel 18 is thermally coupled to the first cooling stage 22. Accordingly, the first stage cryopanel 18 is cooled to the first cooling temperature. The first stage cryopanel 18 has a gap between the first stage cryopanel 18 and the second stage cryopanel assembly 20, and the first stage cryopanel 18 is not in contact with the second stage cryopanel assembly 20. The first stage cryopanel 18 is not in contact with the cryopump housing 70.

The radiation shield 30 is provided to protect the second stage cryopanel assembly 20 from the radiant heat of the cryopump housing 70. The radiation shield 30 extends in a tubular shape (for example, a cylindrical shape) in the axial direction from the intake port 12. The radiation shield 30 is positioned between the cryopump housing 70 and the second stage cryopanel assembly 20, and surrounds the second stage cryopanel assembly 20. The radiation shield 30 includes a shield main opening 34 for receiving a gas from the outside of the cryopump 10 to the internal space 14. The shield main opening 34 is positioned at the intake port 12.

The radiation shield 30 includes a shield front end 36 which defines the shield main opening 34, a shield bottom section 38 which is positioned on a side opposite to the shield main opening 34, and a shield side section 40 which connects the shield front end 36 to the shield bottom section 38. The shield side section 40 extends from the shield front end 36 to the side opposite to the shield main opening 34 in the axial direction, and extends to surround the second cooling stage 24 in the circumferential direction.

The shield side section 40 includes a shield side section opening 44 through which the cryocooler structural section 21 is inserted. The second cooling stage 24 and the second cylinder 25 are inserted from the outside of the radiation shield 30 into the radiation shield 30 through the shield side section opening 44. The shield side section opening 44 is an attachment hole which is formed on the shield side section 40, and, for example, has a circular shape. The first cooling stage 22 is disposed outside the radiation shield 30.

The shield side section 40 includes an attachment pedestal 46 of the cryocooler 16. The attachment pedestal 46 is a flat portion for attaching the first cooling stage 22 to the radiation shield 30, and is slightly recessed when viewed from the outside of the radiation shield 30. The attachment pedestal 46 forms the outer periphery of the shield side section opening 44. The first cooling stage 22 is attached to the attachment pedestal 46. Therefore, the radiation shield 30 is thermally coupled to the first cooling stage 22.

Instead of the radiation shield 30 being directly attached to the first cooling stage 22, in an embodiment, the radiation shield 30 maybe thermally coupled to the first cooling stage 22 via an additional heat transfer member. For example, the heat transfer member may be a short hollow tube having flanges on both ends. The heat transfer member may be fixed to the attachment pedestal 46 by one end flange, and may be fixed to the first cooling stage 22 by the other end flange. The heat transfer member may surround the cryocooler structural section 21 and may extend from the first cooling stage 22 to the radiation shield 30. The shield side section 40 may include the heat transfer member.

In the shown embodiment, the radiation shield 30 has an integral tubular shape. Instead of this, the radiation shield 30 may have the entire tubular shape including a plurality of parts. The plurality of parts may be disposed to have gaps to each other. For example, the radiation shield 30 may be divided into two portions in the axial direction. In this case, the upper portion of the radiation shield 30 is a tube having both open ends, and includes the shield front end 36 and a first section of the shield side section 40. The lower portion of the radiation shield 30 also is a tube having both open ends, and includes a second section of the shield side section 40 and the shield bottom section 38. A slit is formed, which extends in the circumferential direction between the first section and the second section of the shield side section 40. The slit may form at least a portion of the shield side section opening 44. Alternatively, the upper half of the shield side section opening 44 may be formed on the first section of the shield side section 40, and the lower half thereof maybe formed on the second section of the shield side section 40.

The radiation shield 30 defines a gas accommodation space 50 which surrounds the second stage cryopanel assembly 20 between the intake port 12 and the shield bottom section 38. The gas accommodation space 50 is a portion of the internal space 14 of the cryopump 10, and is a region adjacent to the second stage cryopanel assembly 20 in the radial direction.

The inlet cryopanel 32 is provided in the intake port 12 (or, the shield main opening 34, and so on) to protect the second stage cryopanel assembly 20 from radiant heat from an external heat source (for example, a heat source in the vacuum chamber to which the cryopump 10 is attached) of the cryopump 10. In addition, a gas (for example, water) condensed at the cooling temperature of the inlet cryopanel 32 is captured on the surface.

The inlet cryopanel 32 is disposed at a location corresponding to the second stage cryopanel assembly 20 in the intake port 12. The inlet cryopanel 32 occupies the center portion of an opening area of the intake port 12 and forms an annular opening region 51 between the inlet cryopanel 32 and the radiation shield 30. When viewed in the axial direction, a shape of the inlet cryopanel 32 is a disk shape. The inlet cryopanel 32 may occupy at most ⅓, or at most ¼ of the opening area of the intake port 12. Accordingly, the opening region 51 may occupy at least ⅔, or at least ¾ of the opening area of the intake port 12. The opening region 51 is positioned at a location corresponding to the gas accommodation space 50 in the intake port 12. The opening region 51 is an inlet of the gas accommodation space 50, and the cryopump 10 receives gas into the gas accommodation space 50 through the opening region 51.

The inlet cryopanel 32 is attached to the shield front end 36 via an inlet cryopanel attachment member 33. The inlet cryopanel attachment member 33 is a linear (or cruciform) member bridged to the shield front end 36 along a diameter of the shield main opening 34. Thus, the inlet cryopanel 32 is fixed to the radiation shield 30 and is thermally coupled to the radiation shield 30. The inlet cryopanel 32 is close to but not in contact with the second stage cryopanel assembly 20.

The second stage cryopanel assembly 20 is provided at a center portion of the internal space 14 of the cryopump 10. The second stage cryopanel assembly 20 includes an upper structure **20*a* and a lower structure 20*b*. The second stage cryopanel assembly 20 comprises a plurality of cryopanels 60 arranged in the axial direction. The plurality of cryopanels 60** are arranged at intervals in the axial direction.

The upper structure **20*a* of the second stage cryopanel assembly 20 includes a plurality of upper cryopanels 60*a* and a plurality of heat transfer bodies (also referred to as heat transfer spacers) 62. The plurality of heat transfer bodies 62 are arranged in a columnar shape in the axial direction. The plurality of upper cryopanels 60*a* and the plurality of heat transfer bodies 62 are stacked in the axial direction between the intake port 12 and the second cooling stage 24. Accordingly, the upper structure 20*a* is disposed axially above the second cooling stage 24. The upper structure 20*a* is fixed to the second cooling stage 24 via a heat transfer block 63 and is thermally coupled to the second cooling stage 24. Therefore, the upper structure 20*a*** is cooled to the second cooling temperature.

The lower structure **20*b* of the second stage cryopanel assembly 20 includes a plurality of lower cryopanels 60*b* and a second stage panel attachment member 64. The second stage panel attachment member 64 extends axially downward from the second cooling stage 24. The plurality of lower cryopanels 60*b* are attached to the second cooling stage 24 via the second stage panel attachment member 64. Accordingly, the lower structure 20*b* is thermally coupled to the second cooling stage 24** and is cooled to the second cooling temperature.

An adsorption region 66 is formed on a surface of at least a portion of the second stage cryopanel assembly 20. The adsorption region 66 is provided to capture a non-condensable gas (for example, hydrogen) by adsorbing. For example, the adsorption region 66 is formed by adhering an adsorption material (for example, activated carbon) to a cryopanel surface. The adsorption region 66 may be formed at a shadowed position of the cryopanel 60 adjacent above so as not to be seen from the intake port 12. For example, the adsorption region 66 is formed on the entire region of a lower surface (rear surface) of the cryopanel 60. The adsorption region 66 maybe formed on an upper surface and/or a lower surface of the upper cryopanel **60*a*. The adsorption region 66 may be formed on an upper surface and/or a lower surface of the lower cryopanel 60*b***.

In addition, a condensation region for capturing a condensable gas by condensation is formed on a surface of at least a portion of the second stage cryopanel assembly 20. For example, the condensation region is a missing region of the adsorption material on the cryopanel surface, and a cryopanel substrate surface, for example, a metal surface is exposed to the condensation region. An upper surface outer peripheral section of the cryopanel 60 (for example, upper cryopanel 60*a*) may be the condensation region.

As shown in FIGS. 1 and 2, the upper cryopanel 60*a* has an inverted truncated cone shape and is disposed to be circular when viewed in the axial direction. A center of upper cryopanel 60*a* is positioned on the center axis C. The upper cryopanel 60*a* can have a mortar shape, a bowl shape, or a ball shape. The upper cryopanel 60*a* has a large dimension (that is, has a large diameter) at an upper end portion 74 and has a smaller dimension (that is, has a smaller diameter) at a lower end portion 76. The upper cryopanel 60*a* includes an inclined region 78 which connects the upper end portion 74 and the lower end portion 76 to each other. The inclined region 78 corresponds to a side surface of the inverted truncated cone. Accordingly, the upper cryopanel 60*a* is inclined such that a normal of an upper surface of the upper cryopanel 60*a* intersects the center axis C. The upper cryopanel 60*a* has a plurality of through-holes 80 at the lower end portion 76. The through-hole 80 is provided to attach the upper cryopanel 60*a* to the heat transfer body 62 (or heat transfer block 63).

A first upper cryopanel 60*a* has a smallest diameter. The first upper cryopanel 60*a* is positioned axially uppermost and closest to the inlet cryopanel 32. A second upper cryopanel 60*a* has a diameter slightly larger than that of the first upper cryopanel 60*a*. The same applies to third, fourth, and fifth upper cryopanels 60*a*. An upper cryopanel 60*a* positioned below has a diameter slightly larger than that of the upper cryopanel 60*a* above adjacent to the upper cryopanel 60*a* positioned below.

The inclined regions 78 of the first and second upper cryopanels 60*a* are parallel to each other. In addition, the inclined regions 78 of the third to fifth upper cryopanels 60*a* are parallel to each other. An inclination angle of the first upper cryopanel 60*a* is smaller than an inclination angle of the third upper cryopanel 60*a*. The third, fourth, and fifth upper cryopanels 60*a* are disposed in a nested manner. A lower portion of an upper cryopanel 60*a* positioned above is inserted into an upper cryopanel 60*a* below adjacent to the upper cryopanel 60*a* positioned above.

Further details of the upper structure 20*a* will be described later. In addition, a specific configuration of the upper structure 20*a* is not limited to the above. For example, the upper structure 20*a* may have any number of upper cryopanels 60*a*. The upper cryopanel 60*a* may have a flat plate, a conical shape, or other shapes. For example, the first upper cryopanel 60*a* may be a flat plate, for example, a disk.

As shown in FIG. 3, the lower cryopanel 60*b* is a flat plate, for example, a disk. The lower cryopanel 60*b* has a diameter larger than that of the upper cryopanel 60*a*. However, in order to attach the lower cryopanel 60*b* to the second stage panel attachment member 64, in the lower cryopanel 60*b*, a cut-out portion 82 is formed from a portion of an outer periphery toward a center portion. In addition, similarly to the upper cryopanel 60*a*, the lower cryopanel 60*b* may have an inverted truncated cone shape, a conical shape, or other shapes.

Unlike the lower cryopanel 60*b*, the upper cryopanel 60*a* does not have the cut-out portion 82. Accordingly, the upper cryopanel 60*a* can take a more effective cryopanel area (that is, the adsorption region 66 and/or the condensation region).

In the adsorption region 66, many activated carbon particles are adhered in an irregular arrangement in a state of being closely arranged on the surface of the cryopanel 60. For example, the activated carbon particles are formed in a cylindrical shape. In addition, the shape of the adsorption material may not be a cylindrical shape, and for example, may be a spherical shape, other formed shapes, or an irregular shape. An arrangement on an adsorption material panel may be a regular arrangement or an irregular arrangement.

The cryopump housing 70 is a case of the cryopump 10 which accommodates the first stage cryopanel 18, the second stage cryopanel assembly 20, and the cryocooler 16, and is a vacuum vessel which is configured so as to hold vacuum sealing of the internal space 14. The cryopump housing 70 includes the first stage cryopanel 18 and the cryocooler structural section 21 in a non-contact manner. The cryopump housing 70 is attached to the room-temperature section 26 of the cryocooler 16.

The intake port 12 is defined by a front end of the cryopump housing 70. The cryopump housing 70 includes an intake port flange 72 which extends radially outward from the front end. The intake port flange 72 is provided over the entire periphery of the cryopump housing 70. The cryopump 10 is attached to the vacuum chamber of an evacuation object using the intake port flange 72.

Hereinafter, an operation of the cryopump 10 having the above-described configuration will be described. When the cryopump 10 is operated, first, a pressure inside the vacuum chamber is roughly set to approximately 1 Pa by other appropriate roughing pumps before the cryopump 10 is operated. Thereafter, the cryopump 10 is operated. The first cooling stage 22 and the second cooling stage 24 are respectively cooled to the first cooling temperature and the second cooling temperature by driving of the cryocooler 16. Accordingly, the first stage cryopanel 18 and the second stage cryopanel assembly 20, which are thermally coupled to the first cooling stage 22 and the second cooling stage 24, are respectively cooled to the first cooling temperature and the second cooling temperature.

The inlet cryopanel 32 cools gas flying from the vacuum chamber toward cryopump 10. Gas is condensed so as to have a sufficiently low vapor pressure (for example, $10^{-8}$ Pa or less) at the first cooling temperature on the surface of the inlet cryopanel 32. This gas may be referred to as a first kind of gas. For example, the first kind of gas is water vapor. In this way, the inlet cryopanel 32 through which the first kind of gas can be exhausted. A portion of gas having a vapor pressure which is not sufficiently low at the first cooling temperature can enter the internal space 14 from the intake port 12. Alternatively, the other portion of the gas is reflected by the inlet cryopanel 32, and does not enter the internal space 14.

The gas entering internal space 14 is cooled by the second stage cryopanel assembly 20. Gas having a sufficiently low vapor pressure (for example, $10^{-8}$ Pa or less) at the second cooling temperature is condensed on the surface of the second stage cryopanel assembly 20. This gas may be referred to as a second kind of gas. For example, the second kind of gas is argon. In this way, the second stage cryopanel assembly 20 can exhaust the second kind of gas.

Gas having a vapor pressure which is not sufficiently low at the second cooling temperature is adsorbed to the adsorption material of the second stage cryopanel assembly 20. This gas maybe referred to as a third kind of gas. For example, the third kind of gas is hydrogen. In this way, the second stage cryopanel assembly 20 can exhaust the third kind of gas. Accordingly, the cryopump 10 exhausts various gas by condensation and adsorption, and a vacuum degree of the vacuum chamber can reach a desired level.

Figure 4:
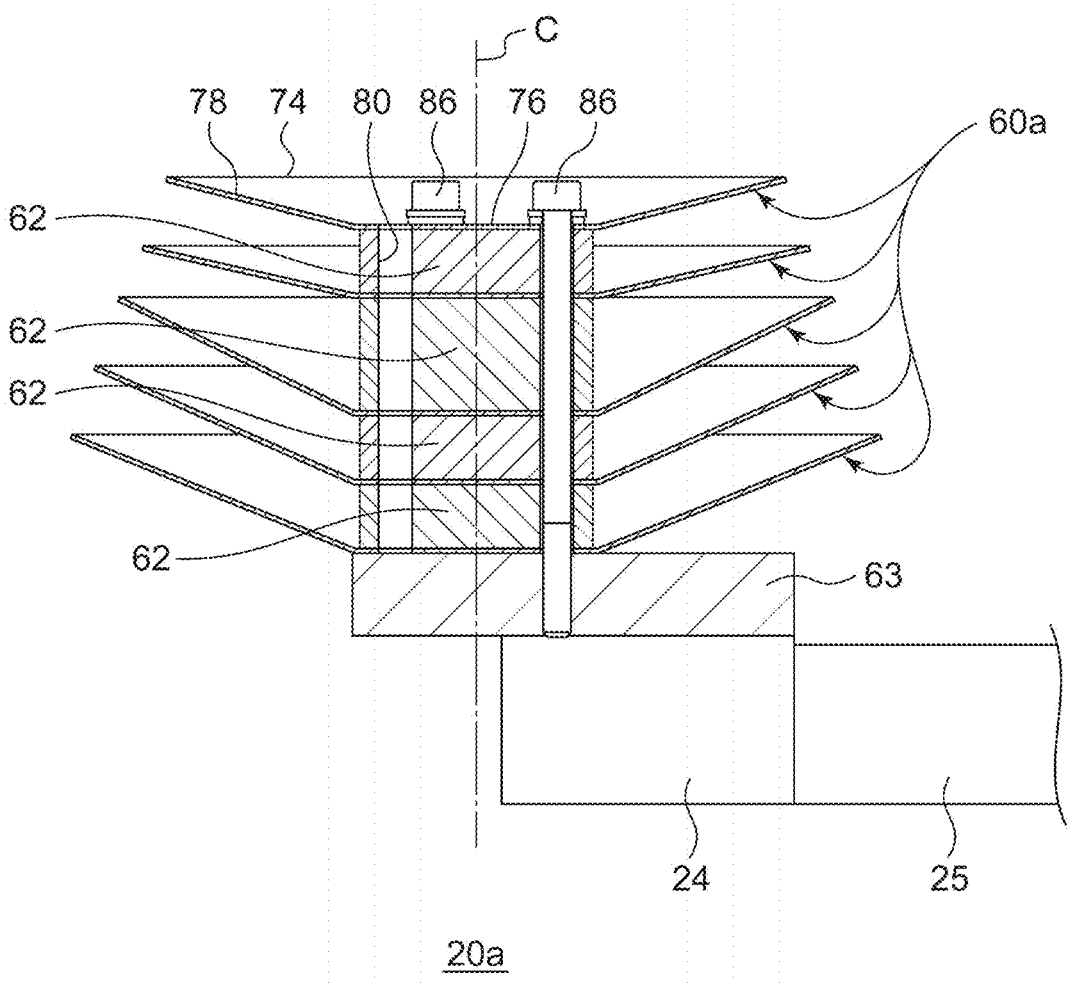
FIG. 4 is a sectional view schematically showing an upper structure of the second stage cryopanel assembly according to the embodiment.
Figure 5:
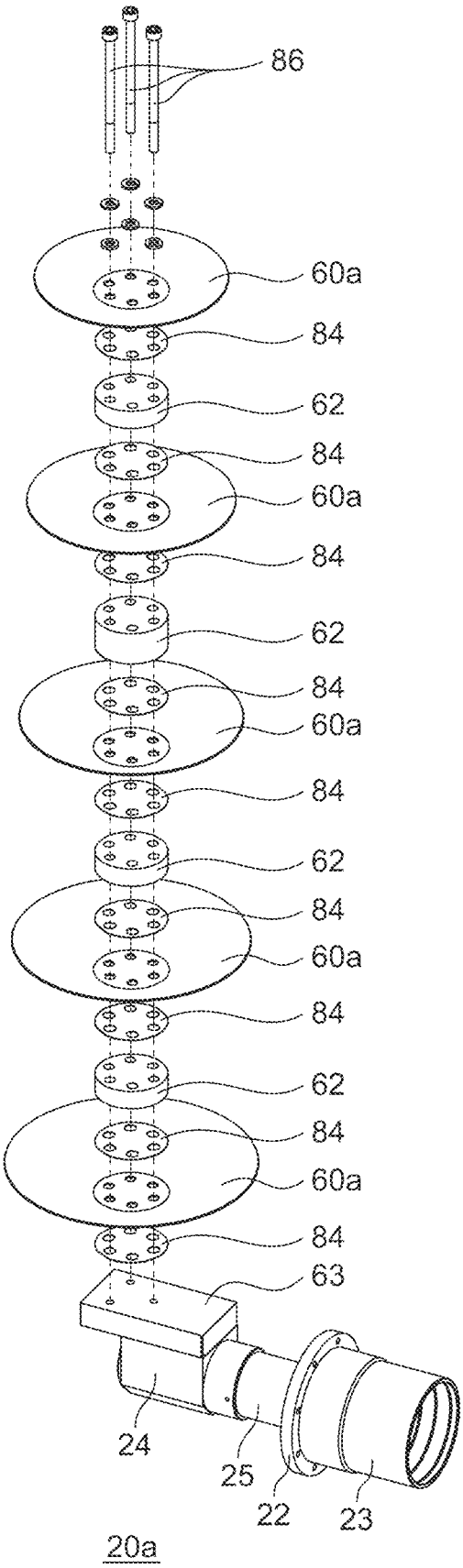
FIG. 5 is an exploded perspective view schematically showing upper structure of the second stage cryopanel assembly according to the embodiment.

Next, the upper structure 20*a* of the second stage cryopanel assembly 20 according to the embodiment will be described in more detail. FIG. 4 is a sectional view schematically showing an upper structure 20*a* of the second stage cryopanel assembly 20 according to the embodiment. FIG. 5 is an exploded perspective view schematically showing upper structure 20*a* of the second stage cryopanel assembly 20 according to the embodiment.

As described above, the upper structure 20*a* of the second stage cryopanel assembly 20 includes the plurality of upper cryopanels 60*a* and the plurality of heat transfer bodies 62. The plurality of heat transfer bodies 62 are axially arranged in a columnar shape. A second stage cryopanel support structure according to the embodiment includes the plurality of heat transfer bodies 62 and includes a cryopanel support column supporting the plurality of upper cryopanels 60*a*. The upper structure 20*a* is configured in axial symmetry with respect to the center axis C.

The plurality of upper cryopanels 60*a* and the plurality of heat transfer bodies 62 are stacked in the axial direction. The plurality of upper cryopanels 60*a* and the plurality of heat transfer bodies 62 are stacked in the axial direction such that at least one heat transfer body 62 is positioned between two upper cryopanels 60*a* adjacent to each other. The plurality of upper cryopanels 60*a* and the plurality of heat transfer bodies 62 are alternately stacked in the axial direction. The stacked configuration has an advantage of facilitating an assembly operation. In addition, it is also to adjust the number of upper cryopanels 60*a* mounted on the cryopump 10 (only by changing the number of stacked cryopanels).

Each heat transfer body 62 has a columnar shape. The heat transfer body 62 has a relatively short columnar shape and an axial height of the heat transfer body 62 is smaller than a diameter of the heat transfer body 62.

The plurality of heat transfer bodies 62 are arranged in a columnar shape in the axial direction, and each of the plurality of heat transfer bodies 62 has a circular end surface. Accordingly, a cross-sectional area (a cross section perpendicular to the axial direction) of the heat transfer body 62 can be made relatively large while a dimension (for example, a radius) of the heat transfer body 62 can be made relatively small. If the dimension of the heat transfer body 62 decreases, it is possible to increase an area of the adsorption region 66 (and/or the condensation region), which improve the exhaust performance of the cryopump 10. If the cross-sectional area increases, it is possible to increase an amount of heat transfer in the axial direction. Accordingly, it is possible to decrease a cooling time of the plurality of heat transfer bodies 62 and the upper structure 20*a* of the second stage cryopanel assembly 20.

An axial height of the heat transfer body 62 defines an axial distance between two adjacent upper cryopanels 60*a*. By decreasing the axial height of the heat transfer body 62, the upper cryopanel 60*a* can be densely arranged. As described above, even if the heat transfer body 62 is thinned in the axial direction, a cross-sectional area (a cross section perpendicular to the axial direction) of the heat transfer body 62 is maintained, and thus, the amount of heat transfer of the heat transfer body 62 is significantly not affected.

The upper cryopanel 60*a* includes a center disk (that is, lower end portion 76) having a size corresponding to the circular end surface of the heat transfer body 62 and a conical cryopanel surface (that is, the inclined region 78) which is inclined from the center disk toward the intake port 12. The center disk of the upper cryopanel 60*a* becomes an attachment surface to the heat transfer body 62. The conical cryopanel surface extends obliquely upward from an outline of the circular end surface of the heat transfer body 62. Similarly to the heat transfer body 62, a diameter of the center disk is relatively small, and thus, it is possible to relatively increase the conical cryopanel surface. In addition, compared to a circular shape having the same diameter as that of the conical cryopanel surface, it is possible to increase the cryopanel area. Accordingly, it is possible to increase the area of the adsorption region 66 (and/or condensation region) of the upper cryopanel 60*a*.

An outer diameter of (circular end surface) of the heat transfer body 62 maybe smaller than ½, smaller than ⅓, smaller than ⅓, smaller than ¼ of an outer diameter of (upper end portion 74) of the upper cryopanel 60*a*. The outer diameter of the heat transfer body 62 may be larger than 1/10 or larger than ⅕ of the outer diameter of the upper cryopanel 60*a*.

The upper structure 20*a* of the second stage cryopanel assembly 20 includes an intervening layer 84 between the upper cryopanel 60*a* and the heat transfer body 62. The intervening layer 84 is sandwiched between the upper cryopanel 60*a* and the heat transfer body 62 axially adjacent to each other to ensure an improved thermal contact. More specifically, the intervening layer 84 is interposed between the center disk of the upper cryopanel 60*a* and the circular end surface of the heat transfer body 62. The intervening layer 84 is formed of a softer material than the upper cryopanel 60*a* and the heat transfer body 62. For example, the intervening layer 84 is formed of an indium sheet (a sheet-like member formed of indium). A diameter of the intervening layer 84 may be slightly larger than the diameter of the heat transfer body 62 and may be smaller than the diameter of the center disk of the upper cryopanel 60*a*.

The upper structure 20*a* of the second stage cryopanel assembly 20 includes a plurality of fastening members 86 which axially penetrate the plurality of upper cryopanels 60*a* and the plurality of heat transfer bodies 62. The upper cryopanels 60*a*, the heat transfer bodies 62, and the intervening layers 84 are fixed to the heat transfer block 63 by the fastening members 86. The upper structure 20*a* is fixed to the second cooling stage 24 by the fastening members 86. In this way, the plurality of upper cryopanels 60*a* and the plurality of heat transfer bodies 62 can be collectively fastened and fixed to each other at one time, and thus, the manufacturing (assembly work) is easy.

In the shown example, three fastening members 86 are used. In the center disk of the upper cryopanel 60*a*, six through-holes 80 are formed in the circumferential direction around the center. The through-holes 80 are arranged at equal angular intervals (every 60 degrees) at the same radial position. The through-holes are similarly formed in the heat transfer body 62 and the intervening layer 84. The fastening members 86 are inserted into the through-holes 80. For example, each fastening member 86 is a long screw and the through-hole 80 is a screw hole. For example, the fastening member 86 is formed of stainless steel. Six through-holes 80 are used every other one, and three fastening members 86 are disposed every 120°. Unused through-holes 80 helps to reduce weight of the heat transfer body 62.

A center portion of the heat transfer body 62 is solid and there is not through-hole (that is, void). Therefore, the center portion of the heat transfer body 62 acts as a heat transfer path. This can also help to increase the amount of heat transfer of the heat transfer body 62.

The plurality of upper cryopanels 60*a* are formed of a first material having a first thermal conductivity. The plurality of heat transfer bodies 62 are formed of a second material having a second thermal conductivity. The second thermal conductivity is smaller than the first thermal conductivity. The first material and/or the second material may be a metal material. The first material is copper (pure copper, for example, tough pitch copper). The second material is aluminum (for example, pure aluminum).

The first material has a first density, the second material has a second density, and the second density is smaller than the first density.

The upper cryopanel 60*a* may include a cryopanel substrate which is formed of the first material, and a coating layer (for example, a nickel layer) which is formed of a material different from the first material and coats the cryopanel substrate. Similarly, the heat transfer body 62 may include a main body which is formed of the second material and a coating layer (for example, a nickel layer) which is formed of a material different from the second material and coats the main body.

Typically, the cryopanel is formed of copper. In general, copper is one of highest thermal conductivity materials available. However, copper is relatively dense, and thus, the cryopanel tends to be heavy, and as a result, a heat capacity of the cryopanel also tends to increase.

In a case where the cryopanel and the heat transfer body 62 are formed of copper, a high thermal conductivity is realized, and thus, there is an advantage of cooling the upper cryopanel 60*a* to a lower temperature. Meanwhile, the upper structure 20*a* of the second stage cryopanel assembly 20 is heavy, the heat capacity is large, and as a result, it takes a relatively long time to cool the upper structure. However, in the present embodiment, as the material of the heat transfer body 62, a metal material (for example, aluminum) having a relatively high thermal conductivity and a relatively small density although not having a thermal conductivity as high as copper can be adopted. The heat conductivity and weight reduction can be achieved, and thus, a cooling time of the heat transfer body 62 is shortened. In addition, the heat transfer body 62 may be formed of copper.

The plurality of upper cryopanels 60*a* have a first heat capacity, the plurality of heat transfer bodies 62 have a second heat capacity, and the second heat capacity is smaller than the first heat capacity. Here, the first heat capacity is a total heat capacity of the plurality of upper cryopanels 60*a*, and the second heat capacity is a total heat capacity of the plurality of heat transfer bodies 62. In this way, the heat transfer body 62 has a relatively small heat capacity, and thus, the heat transfer body 62 can be cooled at a relatively short time.

All of the plurality of heat transfer bodies 62 are formed of the same material (for example, the second material). However, this is not essential. At least a portion (that is, at least one heat transfer body 62) of the plurality of heat transfer bodies 62 is formed of the second material, and another portion (that is, the remaining heat transfer body 62) of the plurality of heat transfer bodies 62 is different from a material (that is, first material) different form the second material. In this way, the thermal conductivity of at least a portion of the plurality of heat transfer bodies 62 may be larger or smaller than the thermal conductivities of the other portions of the plurality of heat transfer bodies 62. The density of at least a portion of the plurality of heat transfer bodies 62 may be greater or smaller than the densities of the other portions of the plurality of heat transfer bodies 62. The heat capacity of at least a portion of the plurality of heat transfer bodies 62 may be larger or smaller than the heat capacities of the other portions of the plurality of heat transfer bodies 62.

The material of the heat transfer body 62 maybe selected according to a location (for example, axial height) of the heat transfer body 62. For example, in the plurality of heat transfer bodies 62, one or more heat transfer bodies 62 which are disposed at a position relatively close to the low-temperature cooling stage may be formed of the first material, and one or more other heat transfer bodies 62 which are disposed at a position relatively far from the low-temperature cooling stage may be formed of the second material. In other words, in the plurality of heat transfer bodies 62, the first heat transfer body 62 may be formed of the first material and the second heat transfer body 62 may be formed of the second material. The first heat transfer body 62 is disposed at a first axial height, the second heat transfer body 62 is disposed at a second axial height, and the first axial height may be closer to the low-temperature cooling stage than the second axial height. The first and second heat transfer bodies 62 are disposed between the cryopump intake port and the low-temperature cooling stage in the axial direction.

Moreover, the heat transfer block 63 may be formed of the first material. In addition, the heat transfer block 63 may be formed of the second material.

In the cryopump 10 according to the embodiment, the axial stacked configuration of the upper cryopanels 60*a* and the heat transfer bodies 62 is adopted. Accordingly, the upper structure 20*a* of the second stage cryopanel assembly 20 is configured to be axially symmetric so as to include the cryopanel attachment structure. Unlike a typical cryopump having an asymmetric attachment structure, an effective cryopanel area (that is, an adsorption region 66 and/or a condensation region) of the upper cryopanel 60*a* can be made wider. In a cryopump to which the above-described design is applied, the adsorption region 66 of the second stage cryopanel assembly 20 can increase by approximately 15%. Accordingly, a storage capacity of the non-condensable gas increases by approximately 15%. In addition, an exhaust speed of the non-condensable gas is estimated to increase by approximately 2%. Thus, the exhaust performance of the cryopump 10 is improved.

Hereinbefore, embodiments of the present invention are described. It should be understood that the invention is not limited to the above-described embodiment, but may be modified into various forms on the basis of the spirit of the invention. Additionally, the modifications are included in the scope of the invention.

Figure 6:
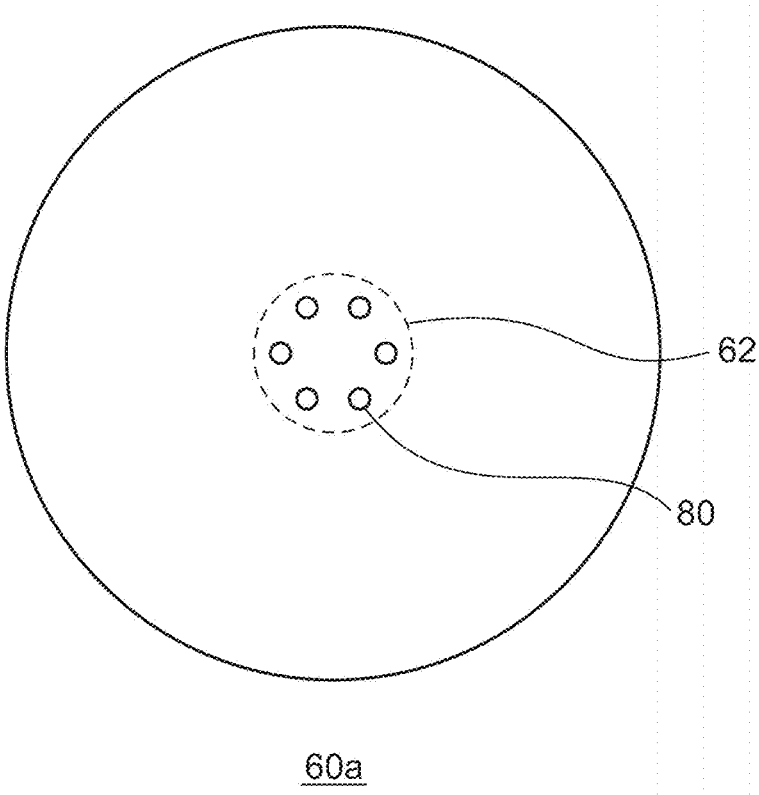
FIG. 6 is a top view schematically showing another example of the upper cryopanel of the second stage cryopanel assembly according to the embodiment.

In the above-described embodiment, at least one upper cryopanel 60*a* has an inverted truncated cone shape. However, as shown in FIG. 6, at least one upper cryopanel 60*a* may be a flat disk having a diameter larger than that of the circular end surface of the heat transfer body 62. In this way, the upper cryopanel 60*a* may be a flat plate, and for example, may have a disk shape. The upper cryopanel 60*a* may include the plurality of through-holes 80.

In the above-described embodiment, the upper structure 20*a* is described as an example. However, the above-described configuration can be applied to the lower structure 20*b*. In this case, as context permits, the upper structure 20*a* may be read as the "lower structure 20*b*" and the upper cryopanel 60*a* may be read as the "lower cryopanel 60*b*".

The embodiment of the present invention can be also be expressed as follows.

1. A cryopump including: a cryocooler which includes a high-temperature cooling stage and a low-temperature cooling stage; a radiation shield which is thermally coupled to the high-temperature cooling stage and axially extends in a tubular shape from a cryopump intake port; and a low-temperature cryopanel section which is thermally coupled to the low-temperature cooling stage, is surrounded by the radiation shield, and includes a plurality of cryopanels and a plurality of heat transfer bodies axially arranged in a columnar shape, and in which the plurality of cryopanels and the plurality of heat transfer bodies are axially stacked.

2. The cryopump described in 1, wherein the plurality of cryopanels are formed of a first material having a first thermal conductivity, at least a portion of the plurality of heat transfer bodies is formed of a second material having a second thermal conductivity, and the second thermal conductivity is smaller than the first thermal conductivity.

3. The cryopump described in any one of 1 or 2, wherein the plurality of cryopanels have a first heat capacity, the plurality of heat transfer bodies have a second heat capacity, and the second heat capacity is smaller than the first heat capacity.

4. The cryopump described in any one of 1 to 3, wherein the plurality of heat transfer bodies are axially arranged in a columnar shape and each of the plurality of heat transfer bodies has a circular end surface.

5. The cryopump described in 4, wherein at least one cryopanel includes a center disk having a size corresponding to the circular end surface of the heat transfer body, and a conical cryopanel surface inclined from the center disk toward the cryopump intake port.

6. The cryopump described in 4 or 5, wherein at least one cryopanel is a flat disk having a diameter larger than that of the circular end surface of the heat transfer body.

7. The cryopump described in any one of 1 to 6, wherein the low-temperature cryopanel section includes a fastening member which axially penetrates the plurality of cryopanels and the plurality of heat transfer bodies.

8. The cryopump described in any one of 1 to 7, wherein the plurality of cryopanels and the plurality of heat transfer bodies are axially stacked between the cryopump intake port and the low-temperature cooling stage.

9. The cryopump described in any one of 1 to 8, wherein the low-temperature cryopanel section includes an intervening layer between the cryopanel and the heat transfer body.

The present invention can be used in a field of a cryopump.

What is claimed is:

1. A cryopump comprising:

a low-temperature cryopanel section comprising:

a plurality of heat transfer bodies arranged axially in a columnar shape, each of the heat transfer bodies is metal and is provided with a through-hole, a plurality of upper cryopanels axially arranged above an upper surface of a low-temperature cooling stage toward a cryopump intake port, each of the upper cryopanels is metal and is provided with an additional through-hole, and a fastening member that, for attachment of the heat transfer bodies to the upper cryopanels, axially penetrates the through-hole and the additional through-hole, a radiation shield configured to:

surround the low-temperature cryopanel section, and axially extend in a tubular shape from the cryopump intake port; and a cryocooler comprising:

a high-temperature cooling stage thermally coupled to the radiation shield, and the low-temperature cooling stage thermally coupled to the low-temperature cryopanel section, wherein the upper cryopanels and the heat transfer bodies are axially stacked in a radially central part of an upper sub-assembly, and wherein one of the heat transfer bodies forms a heat transfer path between two axially adjacent ones of the upper cryopanels.

2. The cryopump according to claim 1, wherein the upper cryopanels are made of a first metal and the heat transfer bodies are made of a second metal, the first metal being different from the second metal.

3. The cryopump according to claim 2, wherein the first metal has a first thermal conductivity, the second metal has a second thermal conductivity, and the second thermal conductivity is smaller than the first thermal conductivity.

4. The cryopump according to claim 1, wherein the plurality of upper cryopanels have a first heat capacity, the plurality of heat transfer bodies have a second heat capacity, and the second heat capacity is smaller than the first heat capacity.

5. The cryopump according to claim 1, wherein the plurality of heat transfer bodies are axially arranged in a cylindrical columnar shape and each of the plurality of heat transfer bodies has a circular end surface.

6. The cryopump according to claim 5, wherein at least one of the upper cryopanels is comprised of:

a center disk having a size corresponding to the circular end surface for one of the heat transfer bodies, and an inverted conical cryopanel surface inclined from the center disk toward the cryopump intake port.

7. The cryopump according to claim 5, wherein at least one of the upper cryopanels is a flat disk having a diameter larger than that of the circular end surface for one of the heat transfer bodies.

8. The cryopump according to claim 1, wherein the upper sub-assembly of the low-temperature cryopanel section includes an intervening layer between one of the upper cryopanels and one of the heat transfer bodies.

9. The cryopump according to claim 1, wherein the cryocooler further comprises a cylinder connecting the high-temperature cooling stage and the low-temperature cooling stage, wherein the high-temperature cooling stage is arranged at an end of the cylinder and the low-temperature cooling stage is arranged at an opposite end of the cylinder, and wherein the upper cryopanels and the heat transfer bodies are arranged on the cryopump center axis vertically passing through a center of the cryopump intake port and the low-temperature cooling stage is arranged offset from the cryopump center axis.

10. The cryopump according to claim 9, wherein the upper cryopanels and the heat transfer bodies are fixed to the low-temperature cooling stage with a heat transfer block extending perpendicular to the cryopump center axis.

11. The cryopump according to claim 1, wherein an outer diameter for one of the heat transfer bodies is smaller than ½ and larger than 1/10 of an outer diameter for one of the upper cryopanels.

12. The cryopump according to claim 1, wherein each of the upper cryopanels has a first radial dimension at an upper end portion thereof and a second radial dimension at a lower end portion thereof, the second radial dimension being smaller than the first radial dimension.

13. The cryopump according to claim 1, wherein the through-hole is formed in the lower end portion of each of the upper cryopanels.

14. The cryopump according to claim 1, wherein each of the upper cryopanels is provided with a plurality of through-holes for attachment to the heat transfer bodies.

15. The cryopump according to claim 1, wherein one of the two axially adjacent upper cryopanels that is axially closer to the cryopump intake port is smaller than the other of the two axially adjacent upper cryopanels.

16. The cryopump according to claim 1, wherein the low-temperature cryopanel section further comprises:

a plurality of lower cryopanels, and a panel attachment member extending axially downward from the low-temperature cooling stage, wherein the lower cryopanels are attached to the low-temperature cooling stage via the panel attachment member.

* * * * *